US010766066B2

(12) United States Patent
Gressenbauer et al.

(10) Patent No.: US 10,766,066 B2
(45) Date of Patent: Sep. 8, 2020

(54) DEVICE FOR SHOOTING A FOUNDRY CORE

(71) Applicant: Nemak, S.A.B. de C.V., Garcia (MX)

(72) Inventors: Markus Gressenbauer, St. Pankraz (AT); Gerhard Strassl, Bruck-Waasen (AT); Michael Resch, Gutau (AT)

(73) Assignee: Nemak, S.A.B. de C.V., Garcia, Nuevo Leon (MX)

( * ) Notice: Subject to any disclaimer, the term of this patent is extended or adjusted under 35 U.S.C. 154(b) by 0 days.

(21) Appl. No.: 16/493,113

(22) PCT Filed: Mar. 15, 2018

(86) PCT No.: PCT/IB2018/051730
§ 371 (c)(1),
(2) Date: Sep. 11, 2019

(87) PCT Pub. No.: WO2018/167704
PCT Pub. Date: Sep. 20, 2018

(65) Prior Publication Data

US 2020/0114417 A1 Apr. 16, 2020

(30) Foreign Application Priority Data

Mar. 15, 2017 (DE) ..... 10 2017 105 478

(51) Int. Cl.
*B22C 9/10* (2006.01)
*B22C 7/06* (2006.01)
(Continued)

(52) U.S. Cl.
CPC ..... *B22C 9/103* (2013.01); *B22C 9/108* (2013.01); *B22C 7/06* (2013.01); *B22C 9/02* (2013.01);
(Continued)

(58) Field of Classification Search
CPC .. B22C 7/06; B22C 9/10; B22C 9/103; B22C 13/12
See application file for complete search history.

(56) References Cited

U.S. PATENT DOCUMENTS

2018/0326474 A1* 11/2018 Stuhldreier ..... B22C 17/00

FOREIGN PATENT DOCUMENTS

GB 829282 A 3/1960
JP 201544217 A 3/2015

OTHER PUBLICATIONS

Düsseldorf, "Sand- und Kokillenguss aus Aluminium", Bundesverband der Deutschen Gießerei-Industrie e.V., 2010, Germany.

* cited by examiner

*Primary Examiner* — Kevin E Yoon
(74) *Attorney, Agent, or Firm* — The Webb Law Firm

(57) ABSTRACT

The present invention relates to a device for shooting a foundry core which surrounds a free inner space on its outer boundaries, with the device having a mould cavity representing the foundry core, which circulates around an inner slider extending along a longitudinal axis and is delimited on its outer side by an outer slider circulating around the mould cavity, with the clear width of the mould cavity being determined by the distance of the inner surface of the outer slider, assigned to the mould cavity, to the outer surface of the inner slider. The device according to the invention allows for operationally-safe manufacture of foundry cores that are tubular in their base form, but finely-structured in their walls and also on a large scale. This is achieved by the inner slider segments being displaceable between a removal position, in which they are positioned approximated in relation to one another and to the longitudinal axis of the inner slider and the clear width of the mould cavity present between the inner slider and the outer slider is increased, into a shooting
(Continued)

position approximating the outer slider, in which the clear width of the mould cavity corresponds to a target specification for the foundry core to be shot.

17 Claims, 6 Drawing Sheets

(51) Int. Cl.

| | |
|---|---|
| ***B22C 13/12*** | (2006.01) |
| *B22C 9/02* | (2006.01) |
| *B22C 9/24* | (2006.01) |
| *B22D 31/00* | (2006.01) |

(52) U.S. Cl.

CPC ..... *B22C 9/24* (2013.01); *B22C 13/12* (2013.01); *B22D 31/002* (2013.01)

DEVICE FOR SHOOTING A FOUNDRY CORE

CROSS-REFERENCE TO RELATED APPLICATIONS

This application is the United States national phase of International Application No. PCT/IB2018/051730 filed Mar. 15, 2018, and claims priority to German Patent Application No. 10 2017 105 478.2 filed Mar. 15, 2017, the disclosures of which are hereby incorporated by reference in their entirety.

BACKGROUND OF THE INVENTION

Field of the Invention

The invention relates to a device for shooting foundry cores, which are required for casting cast parts made of a metal alloy. Such foundry cores are used in the respective casting mould to represent cavities and other shaped elements in the casting part to be cast.

Description of Related Art

The foundry cores are generally formed from a moulding material which is typically a moulding sand/binder mixture which is introduced (shot) at high pressure into the forming cavity of the core shooting device. The flowability of the moulding material, the shooting pressure and the positions at which the moulding material is introduced into the mould cavity of the machine provided to manufacture the cores, are matched such that a complete filling of the mould is achieved even in the case of particularly fine-part cores. After shooting the core, the cores are hardened by applying heat or by gassing with a reaction gas such that they can be introduced into the respective casting mould and withstand the stresses occurring when draining the respective metal melts.

The invention especially relates to a device for shooting a foundry core, which surrounds a free inner space on its outer boundaries, with the device having a mould cavity representing the foundry core, which circulates around an inner slide extending along a longitudinal axis and is delimited on its outer side by an outer slider circulating around the mould cavity, with the clear width of the mould cavity being determined by the distance of the inner surface, assigned to the mould cavity, of the outer slider to the outer surface of the inner slider.

Foundry cores of the type to be manufactured with a device according to the invention are therefore characterised in that they surround an inner space in the manner of a hollow cylinder around which they are guided in a circular manner. In this case, there is the particular challenge during manufacture that the foundry cores generally do not constitute tubes with a solid wall, but rather their wall surrounding the inner space is broken at multiple points or provided with recesses, with material accumulations of varying sizes also being capable of being locally present which are connected to one another by finely branched webs, bridges or other delicately formed moulding elements.

Owing to the circulating, closed shape of the foundry cores, which is circular or ellipsoidal in the cross-section, the demoulding especially of the inner slider is possible only with significant effort in the case of such finely-broken down foundry cores. This effort increases the difficulty of a large scale, quickly-clocked series manufacture of foundry cores of the type in question here.

An example of a device for manufacturing pot-shaped foundry cores with simply shaped, solid circumferential walls without any breakthrough and a similarly simply and solidly shaped base is known from GB 829,282. In the case of this device, an inner slider representing the inner contour of the foundry core and an outer slider representing the outer contour of the foundry core are provided. The inner slider is fastened to a cover and has a rotationally-symmetric shape running slightly conically in the direction of the base of the mould or formed in a calotte-shape. In order to shoot the foundry core, the inner slider is lower in the vertical direction on the space surrounded by the outer slider, with its longitudinal axis being aligned coaxially to the longitudinal axis of the outer slier positioned centrally in the outer slider. In this manner, the mould cavity representing the foundry core is delimited between the outer circumferential wall of the inner slider and the inner circumferential wall of the outer slider and between the base outer surface of the inner slider and the base inner surface of the outer slider. The outer slider is in this case divided into two outer slider halves in a dividing plane running through the centrally arranged longitudinal axis of the outer slider, which are displaceable between a removal position, in which they are moved maximally far away from one another in the transverse direction to the longitudinal axis, and a shooting position, in which they sit closely together and delimit the mould cavity of the device on its outer side. In order to manufacture the foundry core, the respective moulding material is shot and hardened in this mould cavity. In order to demould the core obtained, the inner slider is pulled in the vertical direction out of the finished foundry core. The outer slider halves are then moved away from one another and the finished foundry core can be removed. This manner of demoulding requires the foundry cores to be manufactured to have no undercuts whatsoever and high dimensional stability.

In addition to the previously explained prior art, a device is known from JP 2015-044217 A. The known device in question thus serves to shoot a foundry core, which is formed in a circular shape and surrounds a free inner space on its outer boundaries. At the same time, the device has a mould cavity representing the foundry core, which circulates around an inner slider extending along a longitudinal axis and is delimited on its outer side by an outer slider circulating around the mould cavity. The clear width of the mould cavity is, in this case, determined by the distance of the inner surface of the outer slider, assigned to the mould cavity, to the outer surface of the inner slider. Along dividing planes, which extend in the longitudinal direction of the inner slider, the inner slider is divided into eight inner slider segments in the case of the known device, which are displaceable between a removal position, in which they are positioned approximated in relation to one another and to the longitudinal axis of the inner slider and in which the clear width of the mould cavity present between the inner slider and the outer slider is increased, into a shooting position approximating the outer slider, in which the clear width of the mould cavity corresponds to a target specification for the foundry core to be shot.

Against the background of the previously explained prior art, the object was to provide a device, which allows the operationally-safe manufacture of foundry cores that are tubular in their base form, but finely-structured in their walls and also on a large scale and, in this case, large adjusting paths of the inner slider segment displaceable in each case into the receiving portion, a reduction of the number of wide dividing gaps between the inner slider segments in the shooting position, a simple shape of the inner slider segments and an overall simplified mounting of the inner slider is achieved.

SUMMARY OF THE INVENTION

Advantageous configurations of the invention are indicated in the dependent claims and are explained in detail below as the general inventive concept.

A device according to the invention for shooting a foundry core, which surrounds a free inner space on its outer boundaries, therefore has a mould cavity representing the foundry core which circulates around an inner slider extending along a longitudinal axis and is delimited on its outer side by an outer slider circulating around the mould cavity, with the clear width of the mould cavity being determined by the distance of the inner surface, assigned to the mould cavity, of the outer slider to the outer surface of the inner slider.

In this case, a device according to the invention is characterised in that the inner slider is divided into at least three inner slider segments along dividing planes, which extend in the longitudinal direction of the inner slider, with the inner slider segments being adjustable between a removal position, in which they are positioned approximated in relation to one another and to the longitudinal axis of the inner slider and the clear width of the mould cavity present between the inner slider and the outer slider being increased, into a shooting position approximating the outer slider, in which the clear width of the mould cavity corresponds to a target specification for the foundry core to be shot.

In the case of a device according to the invention, the inner slider is therefore broken down into three or more segments, which are adjustable between a removal position, in which they are positioned closely adjacent to one another, and a shooting position, in which they delimit, with their outer surfaces, the mould cavity determining the shaping of the foundry core to be manufactured on its inner side. The outer surfaces of the inner slider segments are separated from one another by a gap in the shooting position. However, this has proven to be uncritical in practice because it is possible in most applications to readily lay the course of the dividing planes between the inner slider segments adjacent to one another and therefore the course of the gap such that the shaping of the core to be manufactured remains unaffected thereby. In this case, the dividing planes run essentially in the longitudinal direction of the inner slider. That is to say, the inner slider segments are divided longitudinally and not transversely to the longitudinal direction of the inner slider. This does of course not rule out that the dividing planes also run in the transverse direction of the longitudinal direction in sections in order to represent for example offsets protruding or rebounding in the circumferential direction of the inner slider on the inner slider segments. What is decisive is that the inner slider segments can be moved towards one another by a movement directed in the direction of the central longitudinal axis of the inner slider and away from one another by a movement directed away from the central longitudinal axis.

In this manner, the width of the mould cavity representing the core to be shot can be expanded to remove the core also in the region of its inner side assigned to the inner slider such that there is no longer contact between the inner slider segments and the core and the core can consequently be removed from the mould cavity in a collision-free manner after removing the outer slider also.

The segmenting of the inner slider according to the invention can be selected depending on the shaping of the foundry core to be manufactured and of the adjustment path of the inner slider segments required for expansion of the mould cavity for the collision-free removal of the finished foundry core from the device. The greater the number, the greater the variability in the case of the adjustment and shaping of the individual inner slider segments. At the same time, however, the number of the dividing planes of the inner slider and therefore the number of gaps also increases, which, in the case of the inner slider being in the shooting position, separate its individual segments from one another. In practice, it has been found to be favourable here that the inner slider is divided into at least three inner segments, with an upper limit of at most seven or at most five inner slider segments having been proven to be particularly satisfactory in practice.

The arrangement and the course of the dividing planes and the size of the individual segments of the inner slider can in each case be adapted directly to the shaping of the core to be manufactured. Particularly simple adjustment of the inner slider segments between their removal and shooting position can be achieved when the dividing planes between the inner slider segments intersect in the longitudinal axis of the inner slider.

The inner slider segments are preferably formed at least matching in this respect as they have the same proportion of volume taken up by the inner slider. Such regular shaping can be achieved in that the dividing planes between the inner slider segments are arranged distributed at even angular intervals around the longitudinal axis of the inner slider.

The essential uniform shape of the segments of the inner slider of a core shooting device according to the invention of course includes the possibility of individually forming the outer circumferential side of the inner slider segments relevant for the shaping of the foundry core to be manufactured in order to represent different moulding elements on the inner side of the foundry core assigned to the inner slider for each inner slider segment.

As already mentioned, it may be expedient to form the inner slider segments such that they overlap, viewed in the longitudinal direction of the inner slider, through offsets protruding or rebounding in the circumferential direction in sections. In this manner, gap-free transitions can be provided in spite of the division of the inner slider between its segments. To this end, an inner slider segment can have an offset protruding in the circumferential direction, which engages into a correspondingly formed recess of the respectively adjacent inner slider segment. In this case, the height of the offset, protruding in the circumferential direction, of the one inner slider segment can thus be adapted to the height of the recess of the adjacent inner slider segment such that this inner slider segment sits with the upper boundary surface of its recess closely, but displaceably on the upper surface of the offset, engaging into the recess in question, of the other inner slider segment. In the case of the foundry core to be manufactured requiring gap-free transitions between the inner slider segments at regular angular intervals, the inner slider segments can then be subdivided into at least two longitudinal sections from which the one section is offset in the circumferential direction of the inner slider with respect to the other section such that the staggered section protrudes with one offset with respect to the other section of the respective inner slider segment in the circumferential direction and has a recess on its opposing side in the circumferential direction, into which engages the offset, protruding in the circumferential direction, of the inner slider segment adjacent there.

Another possibility to minimise the width of the joint present between the inner slider segments in the shooting position is that in the case of at least three inner slider segments one of these inner slider segments is movable in the radial direction towards the longitudinal axis of the inner slider into a receiving portion of the inner slider, which is delimited laterally by in each case one further slider segment and expands in the direction of the longitudinal axis of the inner slider in the case of the slider segments being in the shooting position. The size of the receiving portion can in this case be dimensioned such that the inner slider segment movable into the receiving portion is firstly moved in the direction of the longitudinal axis of the inner slider to remove the finished core until it is located in the space provided for it in the receiving portion and the other inner slider segments are also then moved in the direction of the centre of the inner slider until the inner slider segments, which laterally delimit the receiving portion in the shooting direction, sit with their lateral surfaces closely on the inner slider segment previously moved into the receiving portion. The inner slider segment previously moved into the receiving portion releases the space in this manner, which the inner slider segments laterally delimiting the receiving portion require in order to also still be able to move into their removal position when they closely abut on the segment displaceable into the receiving portion in the shooting position with their lateral surfaces directed in the circumferential direction. As a result, greater adjustment travel of the inner slider segment displaceable into the receiving portion, a reduction of the number of wide dividing gaps between the inner slider segments in the shooting position, a simple shape of the inner slider segments and an overall simplified mounting of the inner slider is achieved.

The adjustment of the inner slider segments can be achieved simply and quickly by the adjusting movements of the inner slider segments being coupled to one another by means of a guide. In this case, there is no individual adjustment of each individual segment, as would essentially also be possible, but rather the inner slider segments can be moved together in a movement operation coupled together out of the shooting position into the removal position and back out again into the shooting position.

Precisely in the case of an automated operation, it is expedient for an adjusting device to be provided for adjusting the inner slider segments between their removal position and their shooting position. This adjusting device may be a motor drive, which moves the inner slider segments, if necessary controlled by a correspondingly set control device, between their removal and their shooting position.

For the adjustment of the inner slider segments, the adjusting device can comprise a wedge element adjustable in the longitudinal direction of the inner slider, directed with its tip into an inner space of the inner slider surrounded by the inner slider segments and having a wedge surface, which abuts on a surface, assigned to the wedge element, of at least one of the inner slider segments. Depending on the alignment of the wedge surface, in the case of this configuration, as a result of the wedge element being driven into the inner slider, the inner slider segment abutting on it in each case is displaced from the removal position in the direction of the shooting position or from the shooting position into the removal position. If the wedge element is pulled back again, the inner slider segment can be moved back into its previously adopted position. To this end, the inner slider segment is exposed to a suitable, for example resiliently elastic restoring force. Alternatively or additionally, the wedge element can also be articulated or connected to the respective segment via another suitable guide in order to effect the return to the respective starting position.

In particular in the case of a regular, uniform base shape of the inner slider segments, it may be proven to be expedient here for the wedge element to be formed in a mandrel shape and a wedge surface to be assigned on the wedge element to each of the inner slider segments on which the respective assigned inner slider segment abuts.

A further possibility of a coupled adjustment of the inner slider segments between their shooting and removal position is for the adjusting device to comprise a control connecting rod with a connecting rod guide with which at least one of the inner slider segments is articulately coupled and the control connecting rod is adjustable, entraining the inner slider segment, between a position corresponding to the removal position of the inner slider segment and a position corresponding to the shooting position of the inner slider segment.

Such a control connecting rod can be used to individually adjust the individual inner slider segments of a device according to the invention. To this end, a corresponding connecting rod can be assigned to each individual segment.

Minimised technical effort for the adjustment of the inner slider segments results in this connection when a connecting rod guide is assigned to each inner slider segment in the control connecting rod with which the inner slider segment assigned in each case is articulatedly coupled. In particular when the inner slider segments have a uniform base shape, it may be expedient to arrange the connecting rod guides at regular angular intervals distributed around a rotary axis of the control connecting rod arranged coaxially to the longitudinal axis of the inner slider. In this manner, the adjustment of the inner slider segments can be effected by simply revolving the control connecting rod.

In order to allow the outer slider to be easily separated from the finished foundry core, the outer slider can be divided into at least two outer slider segments, which are movable to remove the core from its shooting position, in which they, sitting closely together, delimit the mould cavity on its outer side, into a removed removal position.

In this case, an adjusting device for adjusting the outer slider segments can also be provided for adjusting the outer slider segments between their removal position and their shooting position. This adjusting device assigned to the outer slider segments can be coupled to the adjusting device assigned to the inner slider segments in order to achieve a synchronous adjustment of the outer and inner slider segments. It is also possible to drive the adjusting device provided for adjusting outer and inner slider segments by a common drive.

The adjusting device optionally provided for adjusting the outer slider segments can also comprises a control connecting rod with a connecting rod guide with which at least one of the outer slider segments is articulatedly coupled such that the control connecting rod, entraining the outer slider segment, is adjustable between a position corresponding to the removal position of the outer slider segment and a position corresponding to the shooting position of the outer slider segment. It is also, in turn, possible to couple or combine the connecting rod guide of the outer slider segments with the connecting rod guide of the inner slider segments such that a synchronous movement of the outer and inner slider segments is forced. This is in particular appropriate when a connecting rod guide is assigned to each outer slider segment in the control connecting rod with which the outer slider segment assigned in each case is articulatedly coupled. In this case, a single drive is also sufficient here for the adjustment between the shooting and removal position of the outer and inner segments.

The installation and the operation of the inner and outer sliders provided according to the invention and the components required for their actuation can be simplified as the device according to the invention is equipped with at least one base plate on which the outer slider and the inner slider are mounted. A cover plate can also optionally be provided on which the outer slider and the inner slider are supported at least in their shooting position. The openings or nozzles required to shoot in the respective moulding material can be arranged in or on the base plate or cover plate.

A device according to the invention can also comprise an ejector device for ejecting the finished foundry core. This is optionally arranged and formed such that the foundry core is held on it when the inner slider and the outer slider are in the removal position.

BRIEF DESCRIPTION OF THE DRAWINGS

The invention is explained below in greater detail using a drawing representing exemplary embodiments. Its figures show in each case schematically.

DESCRIPTION OF THE INVENTION

Figure 5:
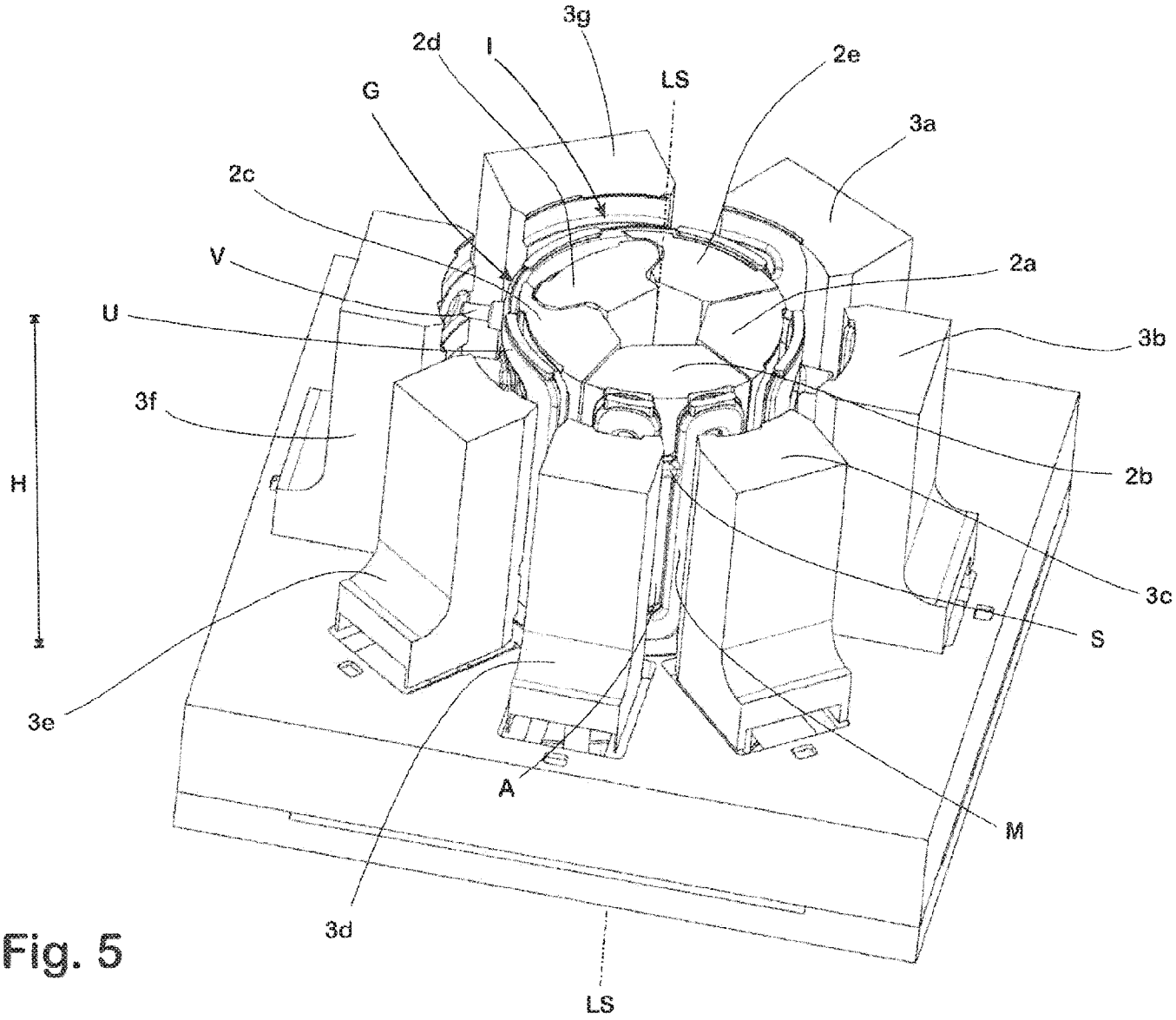
FIG. 5 the device according to FIG. 1 in a removal position in a perspective view.

The device 1 shown in FIGS. 1 to 4 and the device 100 shown in FIGS. 6 to 9 serve to shoot a foundry core G, as is shown by way of example in FIG. 5. The individual parts of the devices 1, 100 are made from the materials proven in the prior art for such purpose.

The foundry core G to be shot made from a conventional moulding material provided as moulding sand/binder mixture therefore has the base shape of a cylindrical hollow body with a circular cross-section, which extends over a height H in the longitudinal direction LR coaxially to the central longitudinal axis LS of the foundry core G. The foundry core G thus surrounds, with its circumferential wall U, an inner space I open at its ends and represented by the inner slider 2. The circumferential wall U is in this case not formed as a solid, closed wall, but rather is broken down into radially protruding projections V, recesses A, local material accumulations M, connection webs S and the like.

The device 1, 100 comprises in each case an inner slider 2, an outer slider 3 and a base plate 4. A mould cavity 5 indicated only schematic for the sake of clarity is surrounded between the outer slider 3 and the inner slider 2, said mould cavity representing the foundry core G to be shot with the device 1. In this case, the inner slide 2, with its outer circumferential surface 6, and the outer slider 3, with its inner circumferential surface 7, delimit the mould cavity 5. The distance of the inner circumferential surface 7 to the outer circumferential surface 6 determines the clear width W of the mould cavity 5.

The inner slider 2 is in each case divided into five uniformly formed inner slider segments 2*a* to 2*e* which are arranged at even angular intervals around the central longitudinal axis LZ of the inner slider 2. The longitudinal axis LZ is located in each of the dividing planes T1 to T5, by way of which the inner slider segments 2*a* to 2*e* are separated from one another. The dividing planes T1 to T5 therefore intersect in the longitudinal axis LZ.

The inner slider segments 2*a* to 2*e* sit on the base plate 4 and are mounted on the same.

In the case of the device 1 represented in FIGS. 1 to 4, the base plate 4 has a central opening 8 aligned concentrically to the longitudinal axis LZ, proceeding from which five slotted guides 9*a*, 9*d* are formed distributed around the centre of the opening 8 at even angular intervals in a star shape.

One of the inner slider segments 2*a* to 2*e* is in each case assigned to the guides 9*a*, 9*d*. In this case, a sword-like guide member 10*a*, 10*d* is fastened on the underside of the inner slider segments 2*a* to 2*e* assigned to the base plate 4, by means of which the inner slider segment 2*a* to 2*e* in question is displaceably mounted in a positive-locking manner in the guide 9*a*, 9*d* assigned in each case.

The inner slider segments 2*a* to 2*e* in each case have an oblique surface 11*a*, 11*d* on their inner side assigned to the longitudinal axis LZ, which is inclined proceeding from the underside of the inner slider segments 2*a* to 2*e* assigned to the base plate 4 in the direction of the upper side 12 of the device 1 such that the distance between the oblique surfaces 11*a*, 11*d* of the inner slider segments 2*a* to 2*e* continually decreases in the direction of the upper side 12.

A mandrel-shaped wedge element 13 is pushed into the opening 8 on which a wedge surface 13*a*, 13*d* is formed at regular angular intervals distributed around the longitudinal axis LZ for each of the inner slider segments 2*a* to 2*e*, which increases proceeding from the underside of the wedge element 13 assigned to the base plate 4 in the direction of the upper side 12 such that the wedge surfaces 13*a*, 13*d*, with the longitudinal axis LZ, form an acute angle. In this case, the inclination of the wedge surfaces 13*a*, 13*d* is the same as the inclination of the oblique surfaces 11*a*, 11*d* of the inner slider segments 2*a* to 2*e* such that the wedge surfaces 13*a*, 13*d* of the wedge element 13 closely abut on the oblique surfaces 11*a*, 11*d* of the inner slider segments 2*a* to 2*e*. A T-groove guide 14*a* to 14*e*, 15*a* to 15*e* is formed into the oblique surfaces 11*a*, 11*d* and the wedge surfaces 13*a*, 13*d*, which extend over the height of the respective oblique surface 11*a*, 11*d* and wedge surface 13*a*, 13*d* and are thus aligned such that a T-groove guide 15*a* to 15*e* of the wedge surfaces 13*a*, 13*d* opposes each T-groove guide 14*a* to 14*e* of the oblique surfaces 11*a*, 11*d*. A double T-shaped slide member, not shown here, is in each case mounted in the T-groove guides 14*a* to 14*e*, 15*a* to 15*e* assigned to one another in such a manner, via which slide member the respective inner slider segment 2*a* to 2*e* is coupled on the wedge element 13 such that the inner slider segments 2*a* to 2*e* are connected to the wedge element 13 in a positive-locking manner in a radial direction R, but the wedge element 13 is displaceable in the longitudinal direction LR of the longitudinal axis LZ relative to the inner slider segments 2*a* to 2*e*.

Figure 2:
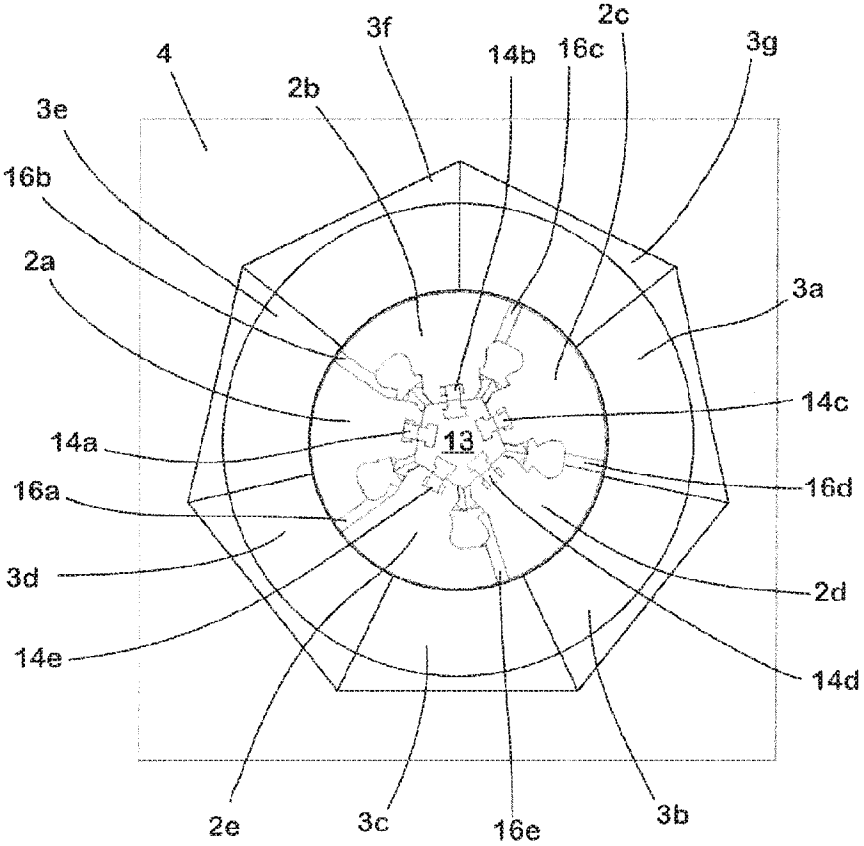
FIG. 2 the device according to FIG. 1 in a view from above.
Figure 1:
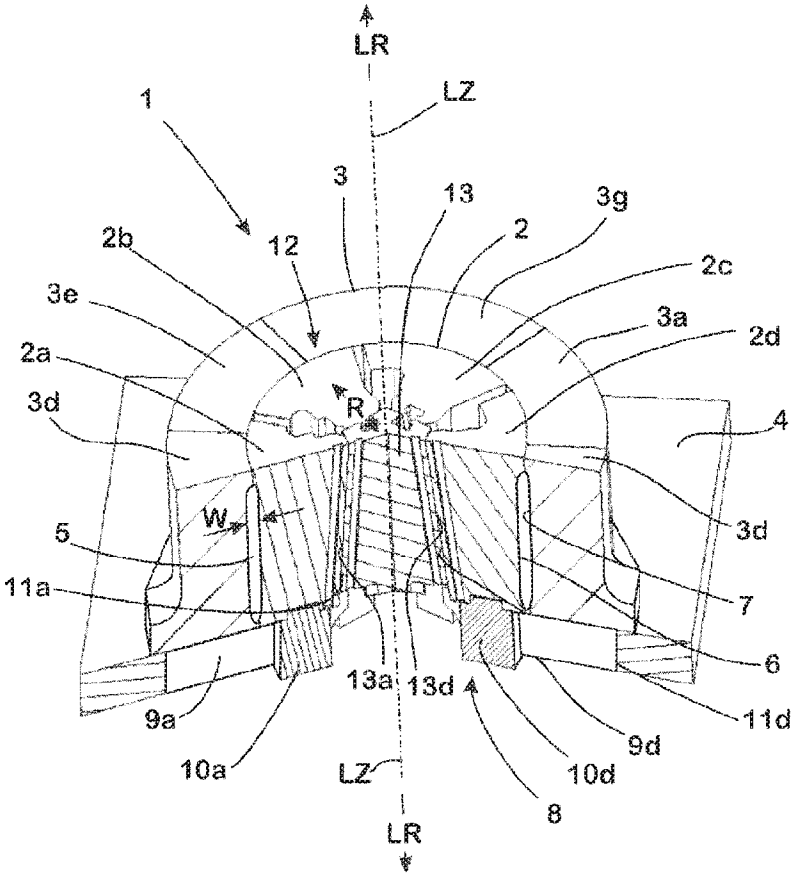
FIG. 1 a prior art first device for shooting a foundry core with perspective view partially cut in the shooting position.
Figure 4:
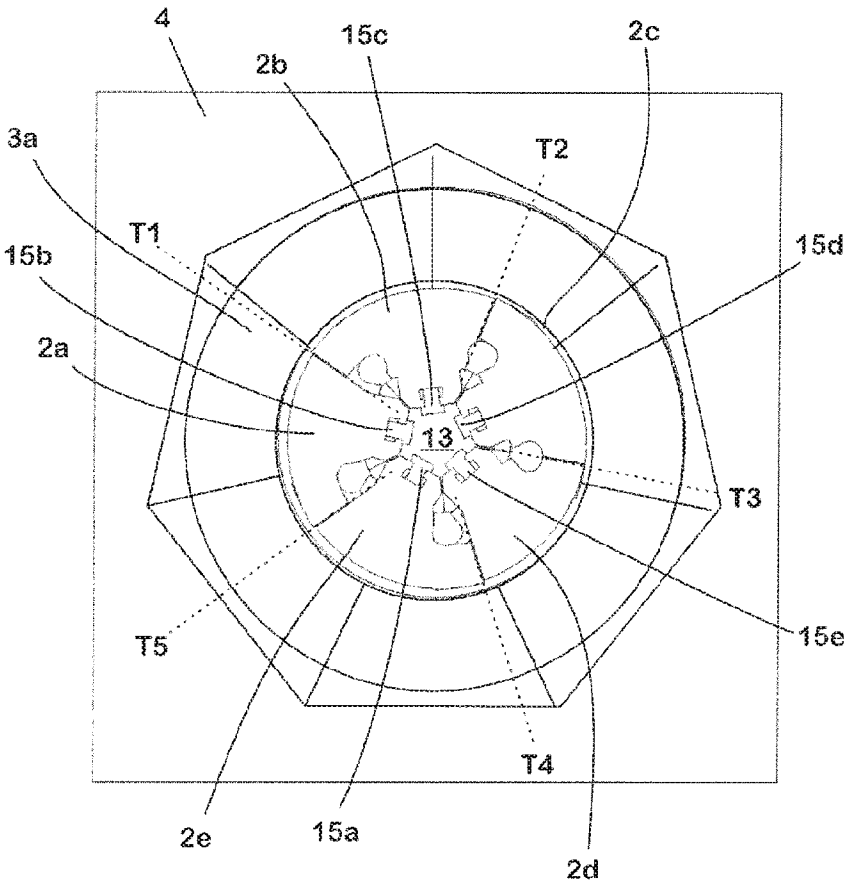
FIG. 4 the device according to FIG. 3 in a view from above.

The wedge element 13 is coupled with an adjusting device not represented here which pushes the wedge element 13 on corresponding control signals in the longitudinal direction LR along the longitudinal axis LZ into the inner slider 2 and pulls said wedge element 13 out of it. If the wedge element 13 is pushed into the inner slider 2, the inner slider segments 2*a* to 2*e* are displaced in the radial direction R away from the longitudinal axis LZ corresponding to the inclination of the wedge surfaces 13*a*, 13*d* of the wedge element 13 and the oblique surfaces 11*a*, 11*d* of the inner slider segments 2*a* to 2*e* abutting thereon until they have reached their shooting position approximated to the outer slider 3 (FIG. 1, 2). The mould cavity 5 is sealed by the outer slider 3 and inner slider 2 tightly from the environment in the shooting position.

In the course of the displacement into the shooting position, gaps 16*a* to 16*e* running in the longitudinal direction LR are formed between the inner slider segments 2*a* to 2*e* which are also present in the region of the outer circumferential surface 6 of the inner slider 2 delimiting the mould cavity 5 on its inner side facing the inner slider 2. Owing to a suitable design of the inner slider segments 2*a* to 2*e* and a corresponding shaping of the foundry core G, these gaps 16*a* to 16*e* are, however, not disruptive.

The moulding material provided for manufacturing the foundry core G is now shot into the mould cavity via shooting nozzles not represented here for the sake of clarity and then hardened in a manner known per se.

Figure 3:
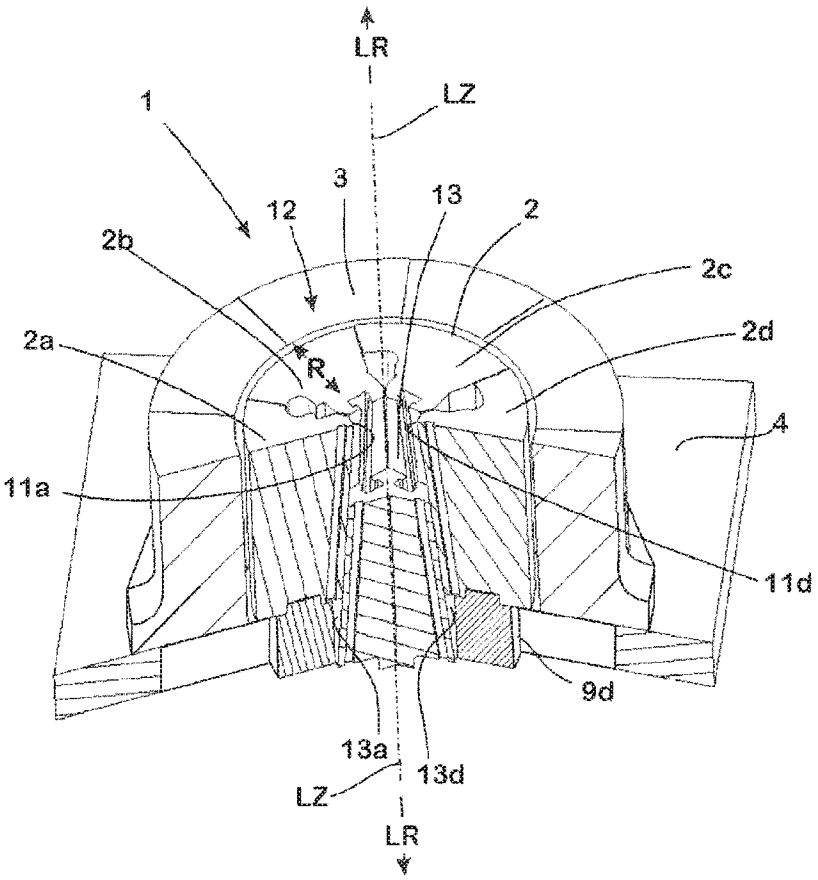
FIG. 3 the device according to FIG. 1 with inner slider and outer slider in the removal position in a view corresponding to FIG. 1.

To remove the finished foundry core G, the wedge element 13 is removed from the inner slider 2 such that the inner slider segments 2*a* to 2*e* coupled thereto are moved on the longitudinal axis LZ. This movement is carried out until the removal position of the inner slider segments 2*a* to 2*e* is reached, in which the gaps 16*a* to 16*e* are closed and the inner slider segments 2*a* to 2*e* abut closely on one another with their lateral surfaces (FIG. 3, 4). In this state, the inner slider segments 2*a* to 2*e* are separated from the finished foundry core G to the extent that the foundry core G can be removed in the longitudinal direction LR from the mould cavity 5, since the outer slider 3 has also been moved in the radial direction R away from it.

To this end, the outer slider 3 is divided into seven outer slider segments 3*a* to 3*g* essentially shaped the same, with the longitudinal axis LZ also laying here in each of the dividing planes between the outer slider segments 3*a* to 3*g*, the dividing planes between the outer slider segments 3*a* to 3*g* also intersect in the longitudinal axis LZ. The outer slider segments 3*a* to 3*g* are moved on corresponding control signals in a direction aligned radially in relation to the longitudinal axis LZ from their shooting position approximated to the inner slider 2 into a removal position away from the inner slider 2 via an adjusting device not shown here, in which removal position the mould cavity 5 is opened to the extent that the foundry core G can be ejected from the mould cavity 5 in the longitudinal direction LR.

In order to eject, the device 1 comprises a plurality of ejectors coupled in a manner known per se in their movement aligned in the longitudinal direction LR axially-parallel to the longitudinal axis LZ, which are also not visible here. The ejectors are guided in the base plate 4 in a manner known per se and in this case are formed and arranged such that the foundry core G, while the inner slider segments 2*a* to 2*e* and the outer slider segments 3*a* to 3*g* are moved in their respective removal position away from the foundry core G, is held on the ejectors. If the inner slider segments 2*a* to 2*e* and the outer slider segments 3*a* to 3*g* are located in their removal positions, the ejectors raise the finished foundry core G in the longitudinal direction LR from the mould cavity 5 such that it can for example be gripped by a gripper, also not shown here, and taken away.

The device 100 shown in FIGS. 6 to 9 matches the device 1 in its basic structure. In the case of the device 100, as with the device 1, the inner slider 2 and the outer slider 3 are thus also divided into inner slider segments 2*a* to 2*e* and outer slider segments 3*a* to 3*g* in the same manner.

One difference between the device 1 and the device 100 consists of the adjusting device provided for adjusting the inner slider segments 2*a* to 2*e* and the outer sliders 3*a* to 3*g* between their shooting and removal positions.

The adjusting device thus comprises, in the case of the device 100, a disc-shaped control connecting rod 17, which is mounted rotatably flat on the underside of the base plate 4 abutting on the underside of the base plate 4. In this case, the rotary axis of the control connecting rod 17 coincides with the longitudinal axis LZ. A connecting rod guide 17*a* to 17*e* is in each case formed into the control connecting rod 17 for each of the five inner slider segments 2*a* to 2*e*.

The connecting rod guides 17*a* to 17*e* arranged at even angular intervals distributed around the longitudinal axis LZ are in each case cut into the control connecting rod 17 as an arched slot. In this case, the connecting rod guides 17*a* to 17*e* are directed radially outwardly proceeding from their one end arranged closer to the longitudinal axis LZ and at the same time are vaulted convexly in the direction of the outer circumference of the control connecting rod 17 viewed in a top view.

A guide pin 18*a* to 18*e* engages into each of the connecting rod guides 17*a* to 17*e*, of which one is in each case fastened on the underside of each of the inner slider segments 2*a* to 2*e*.

Additional outer connecting rod guides 19*a* to 19*g* are formed into the control connecting rod 17 offset radially outwardly in relation to the connecting rod guides 17*a* to 17*e*. The connecting rod guides 19*a* to 19*g* are, in this case, formed with corresponding adaptation of their size proportions like the inner connecting rod guides 17*a* to 17*e*. A guide pin 20*a* to 20*g* is in each case guided into the outer connecting rod guides 19*a* to 19*g*. In each case one of the guide pins 20*a* to 20*g* is fastened to the underside of one of the outer slider segments 3*a* to 3*g*.

Figure 7:
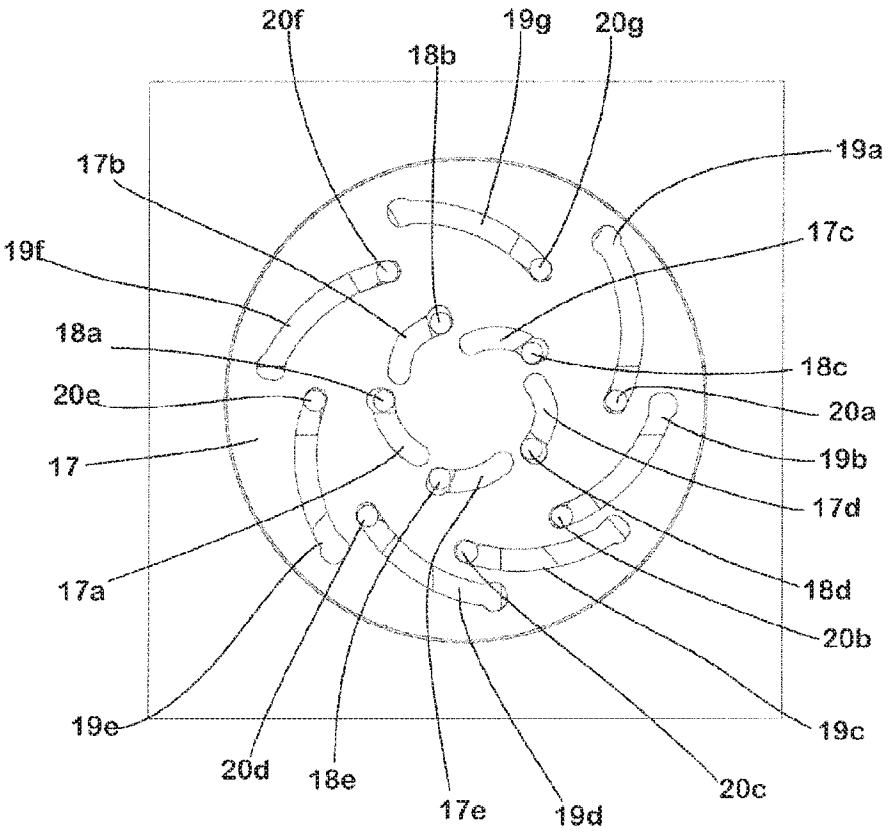
FIG. 7 the device according to FIG. 6 in a view from below.
Figure 9:
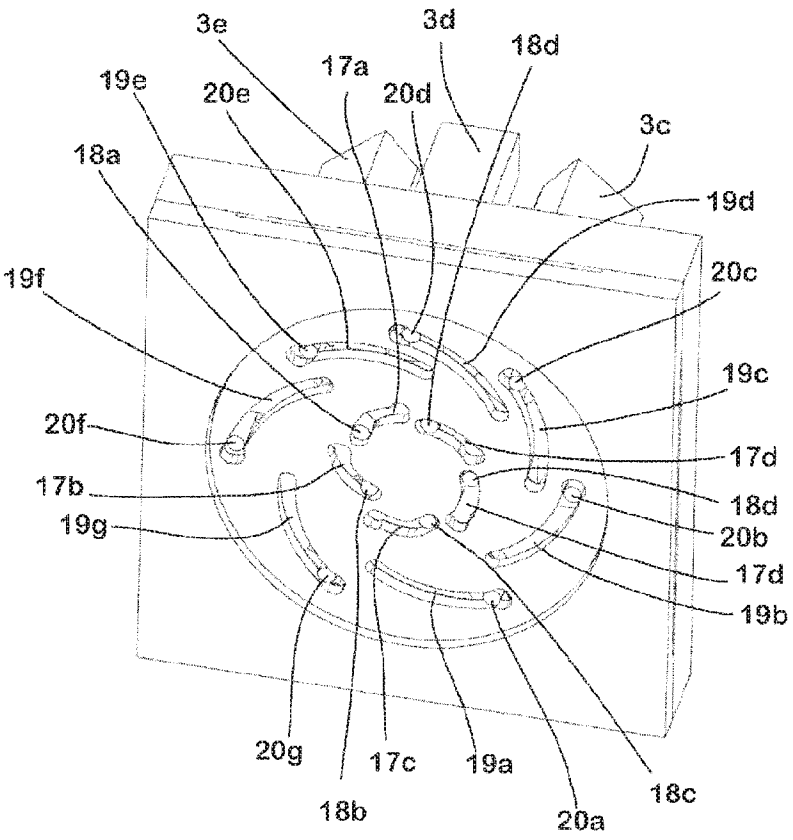
FIG. 9 the device according to FIG. 8 in a perspective view from below.

If the control connecting rod 17 in the case of the arrangement of the connecting rod guides 17*a* to 17*e*, 19*a* to 19*g* shown in the FIGS. 7 and 9, is rotated on a corresponding control signal by means of a rotary drive of the adjusting device, not shown here, counter to the clockwise direction around the longitudinal axis LZ, the inner slider segments 2*a* to 2*e* coupled with said control connecting rod via the guide pins 18*a* to 18*e* engaging into the inner connecting rod guides 17*a* to 17*e* are moved towards the outer slider segments 3*a* to 3*g*. At the same time, the outer slider segments 3*a* to 3*g* coupled via the guide pins 20*a* to 20*g* engaging into the outer connecting rod guides 19*a* to 19*g* are also moved towards the inner slider segments 2*a* to 2*e*.

Figure 6:
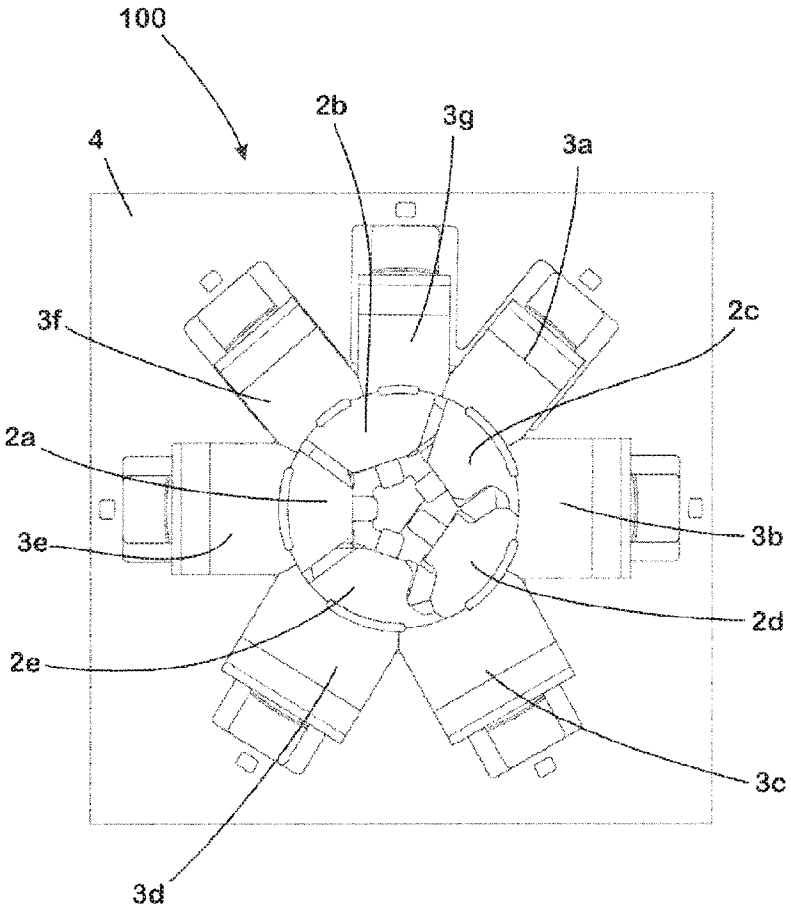
FIG. 6 a second device according to the invention for shooting a foundry core in the shooting position in a view from above.

The rotation of the control connecting rod 17 is stopped when the outer slider segments 3*a* to 3*g* and the inner slider segments 2*a* to 2*e* are moved into the shooting position approximating one another (FIG. 6, 7).

Figure 8:
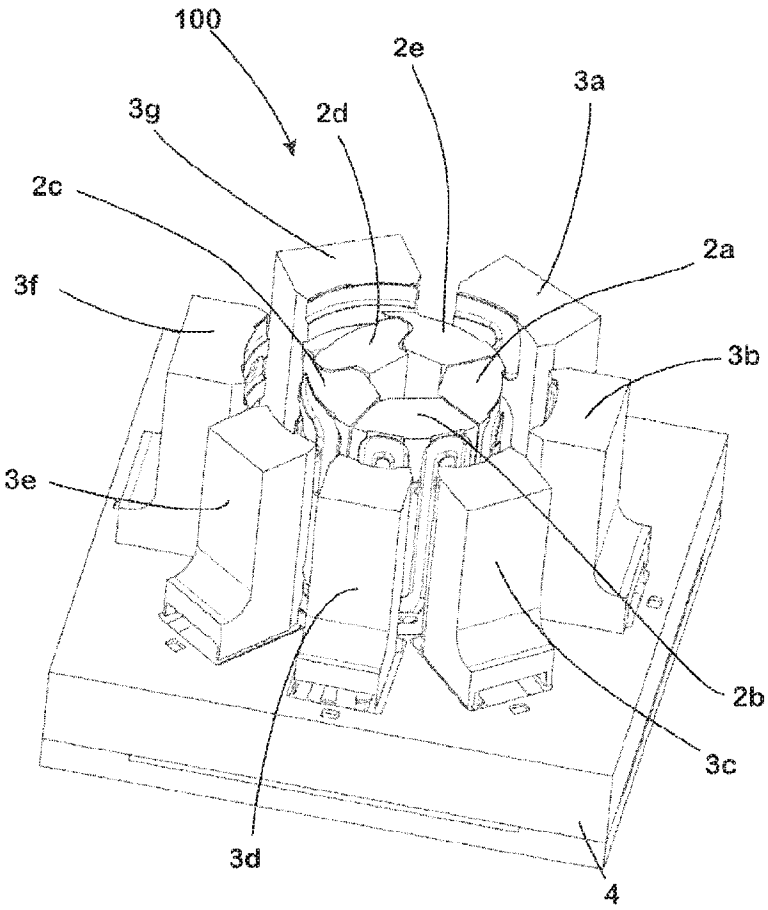
FIG. 8 the device according to FIG. 7 with inner slider in the removal position in the shooting position in a perspective view from above.

If the control connecting rod 17 is, in contrast, rotated in the clockwise direction, the inner slider segments 2*a* to 2*e* are again moved into their removal position, in which they abut closely on one another with their lateral surfaces. The outer slider segments 3*a* to 3*g* are similarly moved into their removal position, in which they are moved maximally far away from the inner slider segments (FIG. 8, 9). The core closed in each case can now be ejected unobstructed from the device 100.

Figure 10:
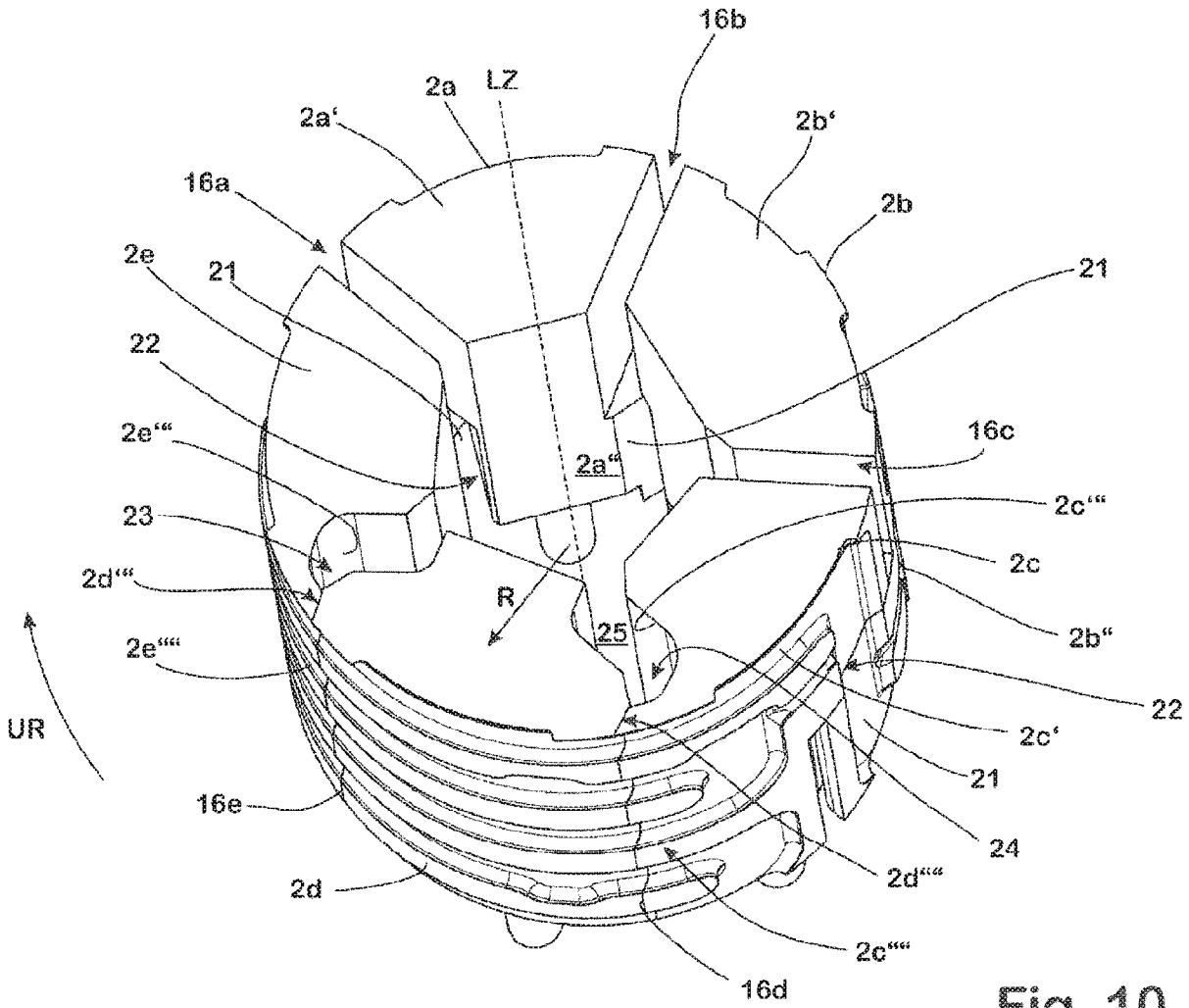
FIG. 10 an inner slider in a perspective view.

FIGS. 6 to 9 and in particular FIG. 10 schematically show an example of how the inner slider segments 2*a* to 2*e* of the inner slider 2 could be configured such that the gaps 16*a* to 16*e* resulting between them when being displaced into the shooting position do not disrupt the manufacture of the foundry core G.

The inner slider segments 2*a*, 2*b* shown there have, in each case, an upper longitudinal section 2*a*', 2*b*' and a lower longitudinal section 2*a*", 2*b*". The lower longitudinal sections 2*a*", 2*b*" are, in each case, offset in the circumferential direction UR with respect to the upper longitudinal section 2*a*', 2*b*' such that the lower longitudinal section 2*a*", 2*b*" in each case protrudes in the circumferential direction UR over the upper longitudinal section 2*a*', 2*b*' with a offset 21 on the one side of the inner slider segment 2*a*, 2*b* in question and an equally large recess is formed on its opposing side.

A correspondingly shaped and arranged recess 22 is formed into the region of the inner slider segment 2*c* assigned to the inner slider segment 2*b* such that the inner slider segment 2*b* engages with its offset 21 into the recess 22 of the inner slider 2*c* overlapping the upper longitudinal section 2*c*' of the inner slider 2*c*. Similarly, the inner slider segment 2*e* has, on its side assigned to the inner slider segment 2*a*, an offset formed like the other offsets 21, which engages into the assigned recess 22 of the inner slider segment 2*a*. In the case of adjacent inner slider segments 2*a*, 2*b*; 2*b*, 2*c*; 2*e*, 2*a*, an offset 21 of the one inner slider segment 2*a*, 2*b*, 2*e* in each case consequently engages into a recess 22 of the in each case adjacent inner slider segment 2*a*, 2*b*, 2*c*.

In this case, the heights of the offset 21 and the recess 22 are in each case adapted to one another such that the upper boundary surface of the respective recess 22 sits closely on the upper side of the offset 21 engaging into this recess 22. In this manner, regions overlapping one another in the region of the outer circumferential surface 6 of the inner slider segments 2*a*, 2*b*, 2*c*, 2*e* are formed, between which there are no open gaps, but rather only tight joints such that moulding elements to be represented on the foundry core G can be represented uninterrupted in spite of the gaps 16*a*, 16*b*, 16*c* present between the inner slider segments 2*a*, 2*b*, 2*c* and 2*e*.

The inner slider segment 2*d* and the inner slider segments 2*c* and 2*e* adjoining inner slider segment 2*d* are configured in a different manner such that only closely closed gaps 16*d*, 16*e* are present in the shooting position between the inner slider segments 2*c*, 2*d*, 2*e*.

To this end, vaultings 23, 24 are formed into the circumferential sides 2*c*" and 2*e*" of the inner slider segments 2*c* and 2*e* adjoining the assigned circumferential lateral surfaces 2*d*'", 2*d*"" of the inner slider segments 2*d* in the circumferential direction UR, said vaultings extending over the height of the inner slider segment 2. The vaultings 23, 24 delimit a receiving portion 25 extending over the height of the inner slider segment 2 for the slider segment 2*d* in the inner slider segment 2.

Vaultings 23, 24 are delimited in the radially outer-lying direction R by in each case a narrow edge section 2*c*"" and 2*e*"" of the inner slider segments 2*c*, 2*e* protruding in the circumferential direction UR in the direction of the inner slider segment 2*d*. The edge sections 2*c*"" and 2*e*"", in the case of inner slider segments 2*c* to 2*e* being in the shooting direction, abut closely on the respectively assigned circumferential lateral surface 2*d*'" and 2*d*"" of the inner slider segment 2*d*.

The vaultings 23, 24 and therefore the receiving portion 25 are, in this case, dimensioned and adapted in their shape to the shape of the circumferential lateral surfaces 2*d*'", 2*d*"" and the dimensions of the inner slider segment 2*d* such that the inner slider segment 2*d*, in the case of inner slider segments 2*c*, 2*e* remaining in their shooting positions, can be freely moved into the receiving portion 25 in the direction of the central longitudinal axis LS of the inner slider 2 until it has reached its removal position. In this position, there is a gap between the circumferential lateral surfaces 2*c*"" and 2*e*"""" of the inner slider segments 2*c*, 2*e*, on the one hand, and the circumferential sides 2*d*'" and 2*d*"" of the inner slider segment 2*d*, on the other hand, whose clear width is so great that the inner slider segments 2*c*, 2*e* can also then be pushed with the inner slider segments 2*a*, 2*b* in the direction of the central longitudinal axis LZ into their removal position. If the inner slider segments 2*a*, 2*b*, 2*c*, 2*e* have reached the removal position, all inner slider segments 2*a* to 2*e* abut with their circumferential lateral surfaces closely on the assigned circumferential surfaces of their adjacent inner slider segments 2*a* to 2*e* (FIG. 8).

The movement into the shooting position then takes place in the reverse sequence.

LIST OF REFERENCE NUMERALS

1, 100 device for shooting foundry cores G
2 inner slider
2*a* to 2*e* inner slider segments
2*a*' to 2*e*' upper longitudinal section of the inner slider segments 2*a* to 2*e*
2*a*" to 2*e*" lower longitudinal section of the inner slider segments 2*a* to 2*e*
2*d*'" to 2*d*"" circumferential lateral surfaces of the inner slider segment 2*d*
2*c*'", 2*e*'" circumferential sides of the inner slider segments 2*c* and 2*e*
2*c*"", 2*e*"" edge sections of the inner slider segments 2*c*, 2*e*
3 outer slider
3*a* to 3*d* outer slider segments
4 base plate
5 mould cavity
6 outer circumferential surface of the inner slider 2
7 inner circumferential surface of the outer slider 3
8 central opening of the base plate 4
9*a*, 9*d* slotted guides
10*a*, 10*d* guide members
11*a*, 11*d* oblique surfaces of the inner slider segments 2*a* to 2*e*
12 upper side of the device 1
13 mandrel-like wedge element
13*a*, 13*d* wedge surfaces of the wedge element 13
14*a* to 14*e* T-groove guide of the inner slider segments 2*a* to 2*e*
15*a* to 15*e* T-groove guide of the wedge element 13
16*a* to 16*e* gaps
17 disc-shaped control connecting rod
17*a* to 17*e* inner connecting rod guides
18*a* to 18*e* guide pins
19*a* to 19*g* outer connecting rod guides
20*a* to 20*g* guide pins

21 offset
22 recess
23, 24 vaultings
25 receiving portion
A recesses of the circumferential wall U
G foundry core
H height of the foundry core G
I inner space of the foundry core G
LR longitudinal direction
LS central longitudinal axis of the foundry core G
LZ central longitudinal axis of the inner slider 2
M local material accumulations of the circumferential wall U
R radial direction
S connection webs of the circumferential wall U
T1 T5 dividing planes between the inner slider segments 2*a* to 2*e*
U circumferential wall of the foundry core G
UR circumferential direction
projections of the circumferential wall U
W clear width of the mould cavity 5

The invention claimed is:

1. A device for shooting a foundry core, which surrounds a free inner space on its outer boundaries, wherein the device has a mould cavity representing the foundry core, which circulates around an inner slider extending along a longitudinal axis and is delimited on its outer side by an outer slider circulating around the mould cavity, wherein a clear width of the mould cavity is determined by a distance of an inner surface, assigned to the mould cavity, of the outer slider to an outer surface of the inner slider, wherein the inner slider is divided into at least three inner slider segments along dividing planes, which extend in a longitudinal direction of the inner slider and wherein the inner slider segments are displaceable between a removal position, in which they are positioned approximated in relation to one another and to the longitudinal axis of the inner slider and the clear width of the mould cavity present between the inner slider and the outer slider is increased, into a shooting position approximating the outer slider, in which the clear with of the mould cavity corresponds to a target specification for the foundry core to be shot, characterised in that one of the inner slider segments is movable in a radial direction on the longitudinal axis of the inner slider into a receiving portion, which is laterally delimited by in each case one further slider segment and expands in the direction of the longitudinal axis of the inner slider in the case of the slider segments being in the shooting position.

2. The device according to claim 1, characterised in that the dividing planes between the inner slider segments intersect in the longitudinal axis of the inner slider.

3. The device according to claim 2, characterised in that the dividing planes between the inner slider segments are arranged at even angular intervals distributed around the longitudinal axis of the inner slider.

4. The device according to claim 1, characterised in that at least one inner slider segment has an offset protruding in the circumferential direction, which engages into a correspondingly formed recess of the in each case adjacent inner slider segment.

5. The device according to claim 1, characterised in that the movements of the inner slider segments are coupled to one another by means of a guide.

6. The device according to claim 1, characterised in that an adjusting device is provided for adjusting the inner slider segments between their removal position and their shooting position.

7. The device according to claim 6, characterised in that the adjusting device comprises a wedge element, adjustable in the longitudinal direction of the inner slider, directed with its tip into an inner space of the inner slider surrounded by the inner slider elements, having a wedge surface, which abuts on a surface, assigned to the wedge element, of at least one of the inner slider segments.

8. The device according to claim 7, characterised in that the wedge element is formed in a mandrel shape and a wedge surface is assigned to the wedge element of each of the inner slider segments, on which wedge surface the respective assigned inner slider segment abuts.

9. The device according to claim 6, characterised in that the adjusting device comprises a control connecting rod with a connecting rod guide, with which at least one of the inner slider segments is articulatedly coupled and in that the control connecting rod is adjustable, entraining the inner slider segment, between a position corresponding to the removal position of the inner slider segment and a position corresponding to the shooting position of the inner slider segment.

10. The device according to claim 9, characterised in that a connecting rod guide is assigned to each inner slider segment in the control connecting rod, with which the inner slider segment, assigned in each case, is articulatedly coupled.

11. The device according to claim 10, characterised in that the connecting rod guides are arranged at regular angular intervals distributed around a rotary axis of the control connecting rod arranged coaxially to the longitudinal axis of the inner slider.

12. The device according to claim 1, characterised in that the outer slider is divided into at least two outer slider segments, which, for a removal of the finished foundry core, are movable from their shooting position, in which they, sitting closely together, delimit the mould cavity b on its outer side, into a removal position.

13. The device according to claim 12, characterised in that an adjusting device is provided for adjusting the outer slider segments between their removal position and their shooting position.

14. The device according to claim 13, characterised in that the adjusting device for the adjustment of the outer slider segments comprises a control connecting rod with a connecting rod guide with which at least one of the outer slider segments is articulatedly coupled and in that the control connecting rod, entraining the outer slider segment, is adjustable between a position corresponding to the removal position of the outer slider segment and a position corresponding to the shooting position of the outer slider segment.

15. The device according to claim 13, characterised in that a connecting rod guide is assigned to each outer slider segment in the control connecting rod, with which the outer slider segment, assigned in each case, is articulatedly coupled.

16. The device according to claim 1, characterised in that it comprises at least one base plate on which the outer slider and the inner slider are mounted.

17. The device according to claim 1, characterised in that it comprises an ejector device for ejecting the finished foundry core.

* * * * *